US007306483B2

(12) United States Patent
Phillips et al.

(10) Patent No.: US 7,306,483 B2
(45) Date of Patent: Dec. 11, 2007

(54) ELECTRICAL CORD ASSEMBLY

(75) Inventors: Bengie T. Phillips, Sterling, IL (US); Scott A. Melton, Eric, IL (US); Brian W. Smith, Sterling, IL (US)

(73) Assignee: Wahl Clipper Corporation, Sterling, IL (US)

( * ) Notice: Subject to any disclaimer, the term of this patent is extended or adjusted under 35 U.S.C. 154(b) by 0 days.

(21) Appl. No.: 11/429,330

(22) Filed: May 5, 2006

(65) Prior Publication Data

US 2007/0259564 A1 Nov. 8, 2007

(51) Int. Cl.
*H01R 13/60* (2006.01)

(52) U.S. Cl. ..... 439/568

(58) Field of Classification Search ..... 439/501, 439/568, 651, 692, 598
See application file for complete search history.

(56) References Cited

U.S. PATENT DOCUMENTS

| | | | | |
|---|---|---|---|---|
| 2,748,362 | A * | 5/1956 | Andis | 439/269.2 |
| 3,293,589 | A * | 12/1966 | Oakes | 439/268 |
| 3,843,224 | A * | 10/1974 | Gerke et al. | 439/366 |
| 3,986,765 | A | 10/1976 | Shaffer et al. | |
| 4,140,359 | A | 2/1979 | Kunz | |
| 4,403,824 | A * | 9/1983 | Scott | 439/680 |
| 4,526,431 | A | 7/1985 | Kasukawa | |
| 5,069,634 | A | 12/1991 | Chiarolanzio | |
| 5,124,532 | A | 6/1992 | Hafey et al. | |
| 5,425,645 | A | 6/1995 | Skovdal et al. | |
| 5,547,393 | A | 8/1996 | Jansen | |
| 5,637,013 | A | 6/1997 | Weber | |
| 5,941,726 | A | 8/1999 | Koegel et al. | |
| 6,247,941 | B1 * | 6/2001 | Lee et al. | 439/105 |
| 6,267,602 | B1 * | 7/2001 | Mendelson et al. | 439/39 |
| 6,305,388 | B1 | 10/2001 | Zeller | |
| 6,314,648 | B1 | 11/2001 | Hillebrandt | |
| 6,530,793 | B2 * | 3/2003 | Eichhorn et al. | 439/218 |
| 6,558,183 | B1 | 5/2003 | Ji et al. | |
| 6,568,942 | B2 * | 5/2003 | Lau et al. | 439/39 |
| 6,592,392 | B2 | 7/2003 | Po-Heng | |
| 6,703,587 | B2 | 3/2004 | Sena et al. | |
| 6,827,601 | B1 | 12/2004 | Haeberle | |
| 6,863,555 | B2 * | 3/2005 | Ito | 439/353 |
| 6,945,825 | B2 | 9/2005 | Aramoto et al. | |
| 6,957,976 | B2 | 10/2005 | Zhang | |
| 2003/0139086 | A1 | 7/2003 | Chuang | |
| 2003/0222069 | A1 | 12/2003 | Sena et al. | |
| 2004/0209514 | A1 | 10/2004 | Marshall Yoe et al. | |
| 2004/0221458 | A1 | 11/2004 | Pleshek | |

* cited by examiner

*Primary Examiner*—Tho D. Ta
*Assistant Examiner*—Vanessa Girardi
(74) *Attorney, Agent, or Firm*—Greer, Burns & Crain, Ltd.

(57) ABSTRACT

An electrical cord assembly configured for use with an electrical appliance includes a cord having a polygonal end with a first pair of cord sides and a second pair of cord sides, wherein one of the pairs of first and second cord sides is asymmetrical, a socket defining a polygonal opening constructed and arranged for receiving the polygonal end, the polygonal opening having a first pair of socket sides and a second pair of socket sides, wherein one of the pairs of first and second socket sides is asymmetrical, and wherein the polygonal end and the polygonal opening are shaped for releasable mating engagement.

20 Claims, 5 Drawing Sheets

ELECTRICAL CORD ASSEMBLY

BACKGROUND OF THE INVENTION

The present invention relates generally to electrical appliance cords, and more specifically, provides an electrical cord assembly for use with electrical appliances such as hair clippers or trimmers.

Electrical appliances such as shavers, clippers and the like are well known and generally receive their power through an internal battery or an electrical cord that is plugged into a wall outlet. Generally, each such power cord is attached to a single appliance, and the attachment is permanent.

In some cases, through prolonged use, such appliance cords become damaged and require replacement. However, because the attachment is generally permanent, the entire appliance needs to be replaced.

Also, in hair salons or barbershops where several types of clippers or trimmers are plugged in at once, cords can become entangled and create workspace clutter. Workplace efficiency is reduced, and workplace aesthetics suffer from such clutter. Furthermore, corded hair cutting appliances are cumbersome to travel with. Cordless appliances address some of the above concerns, but many hair care professionals prefer corded clippers and trimmers.

Accordingly, there exists a need for an electrical cord assembly that addresses the above issues.

SUMMARY OF THE INVENTION

The above-listed needs are met or exceeded by the present electrical cord assembly, which features a cord/appliance linkage or connecting structure which allows easy, positive connection and release of cords with appliances, particularly hair care appliances. Further, detachability of the present cord from the electrical appliance reduces cord clutter. Also, the present assembly is configured for attachment to several electrical appliances, allowing one cord to be used for several appliances. Finally, damaged cords are more easily replaced than in fixed cord models.

More specifically, the present electrical cord assembly provides a cord having a polygonal end with a first pair of cord sides and a second pair of cord sides, wherein one of the pairs of first and second cord sides is asymmetrical; a socket defining a polygonal opening constructed and arranged for receiving the polygonal end, the polygonal opening having a first pair of socket sides and a second pair of socket sides, wherein one of the pairs of first and second socket sides is asymmetrical; and wherein the polygonal end and the polygonal opening are shaped for releasable mating engagement.

DETAILED DESCRIPTION

Figure 1:
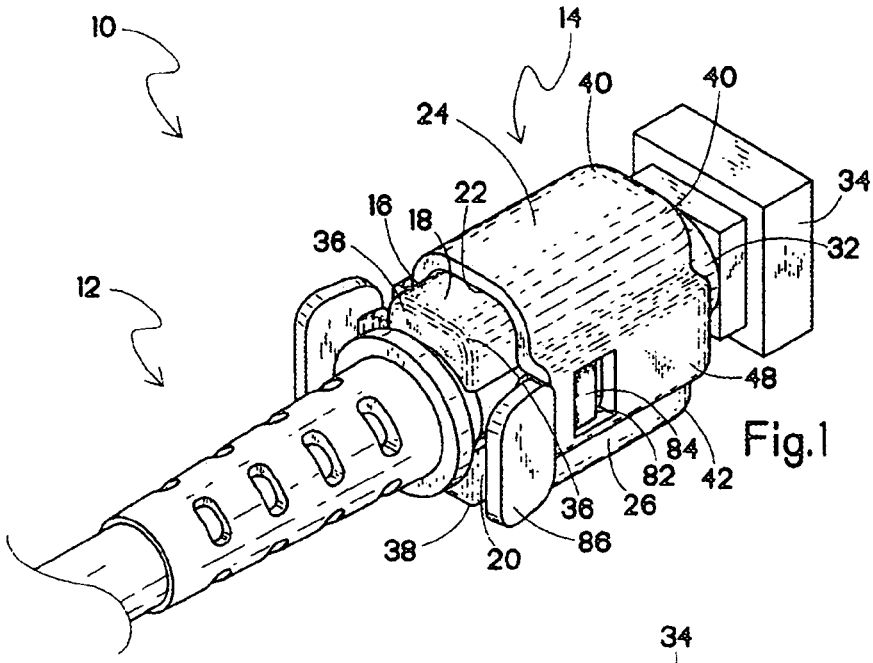
FIG. 1 is a top perspective view of the present electrical cord assembly.
Figure 3:
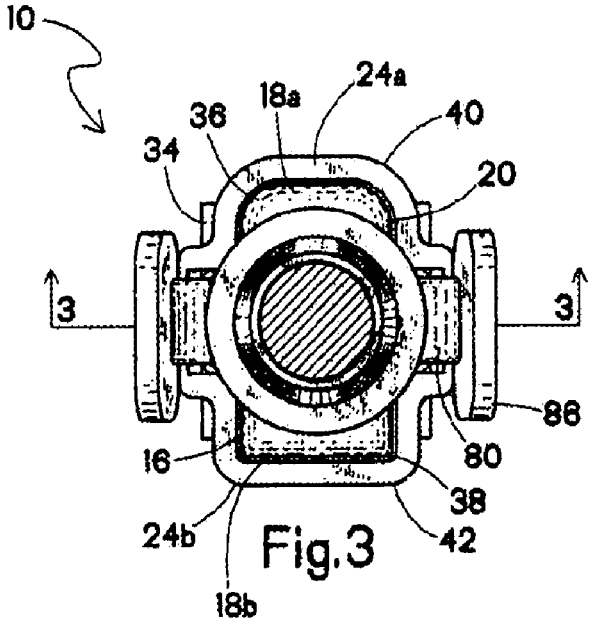
FIG. 3 is a front view of the assembly of FIG. 1.
Figure 4:
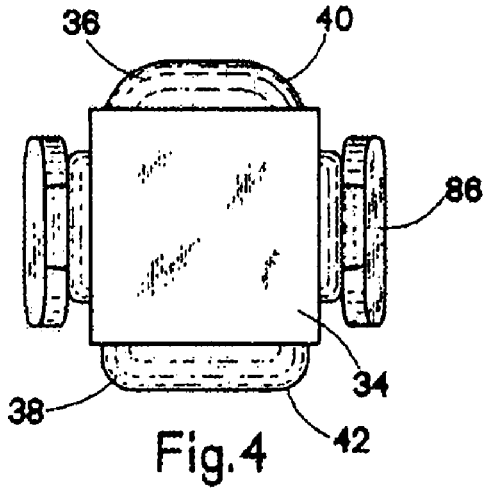
FIG. 4 is a rear view of the assembly of FIG. 1.
Figure 5:
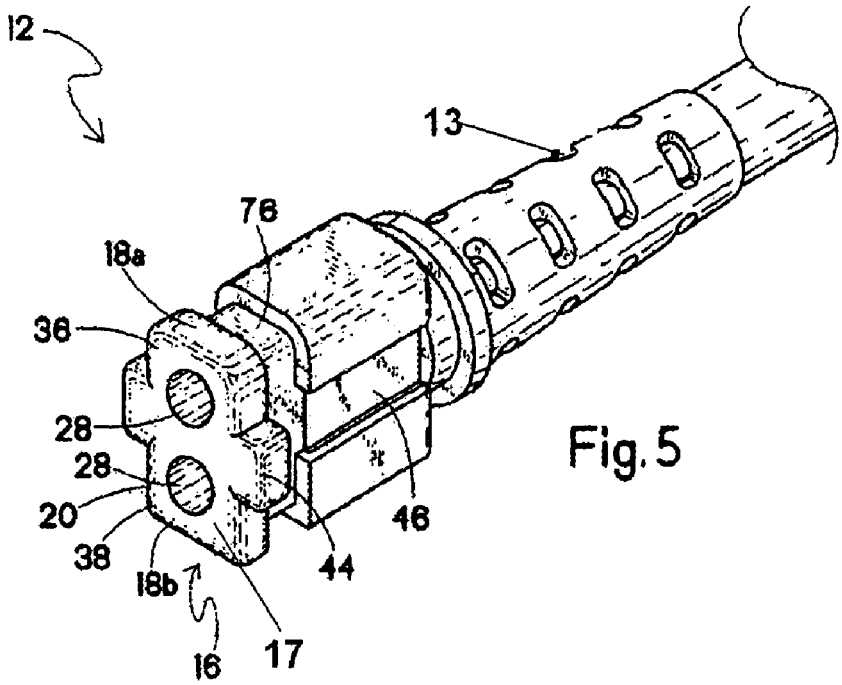
FIG. 5 is a top perspective view of a cord of the assembly of FIG. 1.

Referring to FIGS. 1, 3 and 5, an electrical cord assembly configured for use with an electrical appliance is generally designated 10. The assembly 10 generally includes a cord 12 and a socket 14. The cord 12 has a main cord portion 13 and a polygonal end 16 with a free end 17, a first pair of cord sides 18 and a second pair of cord sides 20, wherein one of the pairs of first and second cord sides is asymmetrical. Specifically, when the polygonal end 16 is sectioned along the line 3-3 (FIG. 3) in a direction perpendicular to a longitudinal axis of the cord 12, one member, 18*a* of the first pair of cord sides 18 is asymmetrical from its counterpart 18*b*. However, it is contemplated that the sides 20 could alternatively be asymmetrical to each other.

The socket 14 defines a polygonal opening 22 constructed and arranged for matingly accommodating or receiving the polygonal end 16. In the present assembly 10, "polygonal" refers to a closed shape having at least two straight sides. However, it is appreciated that other shapes or configurations may be available for the cord 12 and the socket 14. The polygonal opening 22 has a first pair of socket sides 24 and a second pair of socket sides 26, wherein one of the pairs of first and second socket sides is asymmetrical. Similar to the cord 12, when the socket 14 is sectioned along the line 3-3 (FIG. 3) in a direction perpendicular to the longitudinal axis of the cord, one member 24*a* of the first pair of socket sides 24 is asymmetrical from its counterpart 24*b*.

Figure 6:
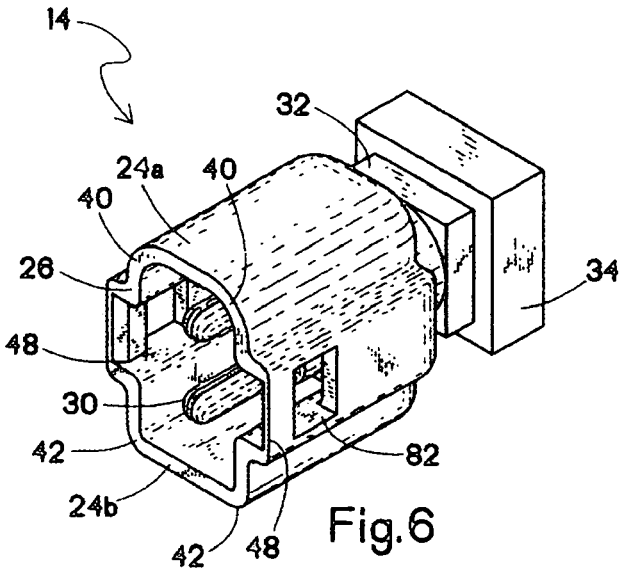
FIG. 6 is a top perspective view of a socket of the assembly of FIG. 1.

As seen in FIGS. 1, 5 and 6, the polygonal end 16 and the polygonal opening 22 are shaped for releasable mating engagement. Because of the asymmetrical orientation of the cord 12 and socket 14, the polygonal end 16 can only be received in the polygonal opening 22 when the first and second pairs of cord sides 18, 20 are aligned with the first and second pairs of socket sides 24, 26. This arrangement ensures proper polarity of the resulting electrical connection of the cord 12 with the socket 14, as will be described in greater detail below.

Referring to FIGS. 5 and 6, the polygonal end 16 includes at least one contact prong opening 28. In addition, the polygonal opening 22 includes at least one and preferably two contact prongs 30 configured for engaging and being electrically connected to the at least one and preferably two contact prong openings 28. It is contemplated that when the at least one contact prong 30 engages the at least one contact prong opening 28, the cord 12 and socket 14 are securely connected via a tight friction fit. However, it is appreciated that the prongs 30 and the openings 28 may be reversed on the cord and socket and that other structures are possible for retaining the cord 12 to the socket 14.

Figure 2:
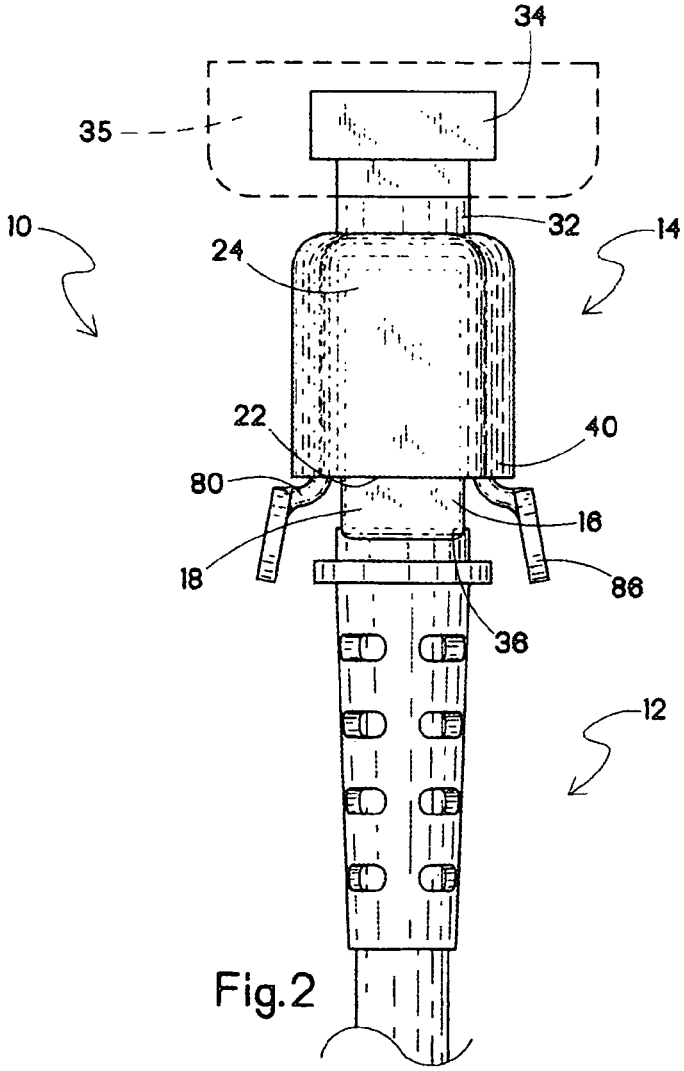
FIG. 2 is a top view of the assembly of FIG. 1.

Referring to FIGS. 1, 2 and 6, the socket 14 further includes a neck portion 32 adjacent the polygonal opening 22, and a radially enlarged block-like cuboidal end 34 adjacent the neck portion, the cuboidal end configured for being secured within a housing 35 of an electrical appliance (shown fragmentarily in phantom). As is known in the art, it is contemplated that the interior of the electrical appliance will be provided with internal walls and/or bosses constructed and arranged for securely receiving the cuboidal end 34 so that the socket 14 cannot be detached from the appliance without disassembly. This arrangement also reduces strain experienced by the assembly 10 when in use, thereby preventing damage to the cord 12 or interfering with the electrical connection.

As shown in FIGS. 1, 3 and 5, one member 18*a* of the first pair of cord sides 18 includes a pair of radiused cord corners 36, and the other member 18*b* includes a pair of right angle cord corners 38. The pair of radiused cord corners 36 is displaced from the pair of right angle cord corners 38 by the second pair of cord sides 20. The second pair of cord sides 20 includes a pair of laterally extending ears 44. The polygonal end 16 further includes a pair of grooves 46, one on each side 20, arranged substantially parallel to the cord longitudinal axis, and each one of the pair of grooves is aligned with, and longitudinally displaced from a corresponding one of the pair of ears 44.

Similarly, as shown in FIG. 6, one member 24*a* of the first pair of socket sides 24 includes a pair of radiused socket corners 40 and the other member 24*b* includes a pair of right angle socket corners 42. The pair of radiused socket corners 40 is displaced from the pair of right angle socket corners 42 by the second pair of socket sides 26. The second pair of socket sides 26 defines a pair of tracks 48, wherein upon engagement with the cord 12, the tracks are aligned with the ears 44 and the grooves 46. The ears 44 are received within the tracks 48, providing a secure and close fit between the cord 12 and the socket 14, and ensuring a desired alignment between the corresponding prong openings 28 and the prongs 30. However, it is recognized that other similar arrangements may be available, as known in the art.

Figure 12:
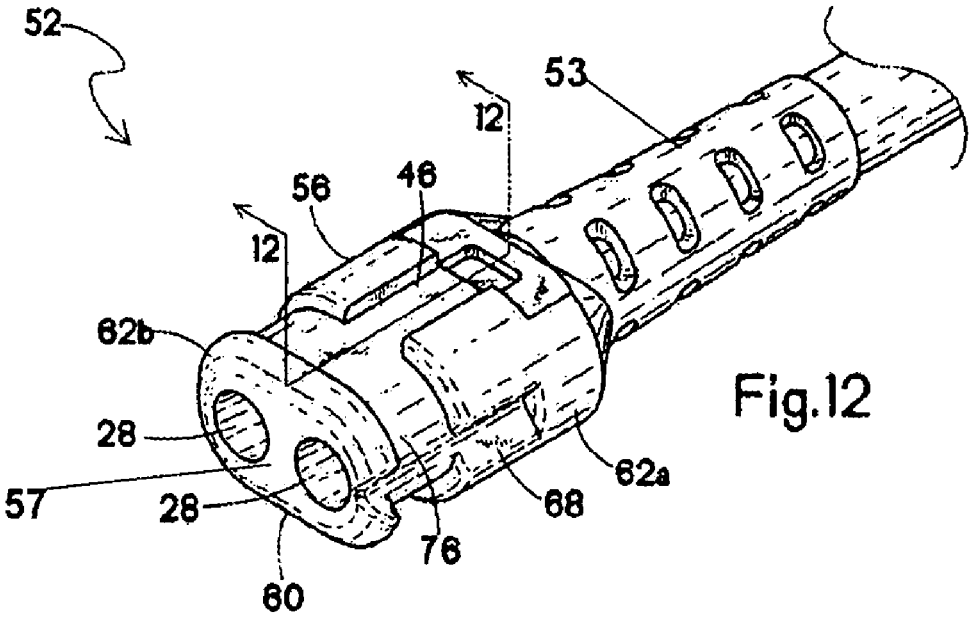
FIG. 12 is a top perspective view of a cord of the assembly of FIG. 8.

In an alternate embodiment of the present assembly shown in FIGS. 8-13, an electrical cord assembly is provided and generally designated 50. It is contemplated that the assemblies 10 and 50 may share components and may be used interchangeably. Included in the assembly are a cord 52 and a socket 54. The cord 52 includes a main cord portion 53 and a polygonal end 56 having a free end 57, and the socket 54 defines a polygonal opening 58, both of which are generally oval shaped. Similar to the embodiment shown in FIGS. 1-6, the polygonal end 56 includes a first and a second pair of cord sides 60, 62. As shown in FIG. 12, when the polygonal end 56 is sectioned along line 12-12 in a direction parallel to a cord longitudinal axis, one member 62*a* of the second pair of cord sides 62 is asymmetrical with the other member 62*b*. Similarly, the polygonal opening 58 includes a first and a second pair of socket sides 64, 66, and when the polygonal opening is sectioned along the line 13-13 (FIG. 13) in a direction parallel to the cord longitudinal axis, one member 66*a* of the second pair of socket sides is asymmetrical with the other member 66*b*. Accordingly, the polygonal end 56 is only received in the polygonal opening 58 when the first and second pairs of cord sides 60, 62 are aligned with the first and second pairs of socket sides 64, 66.

Figure 13:
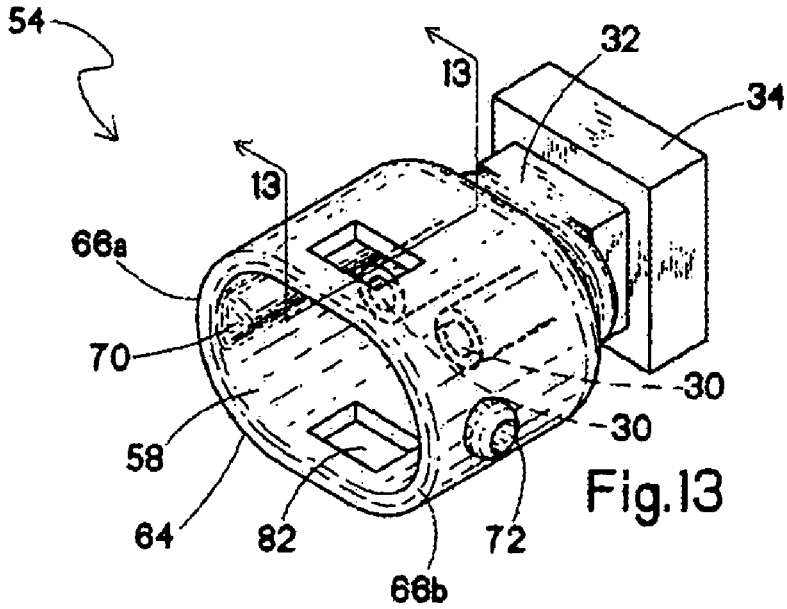
FIG. 13 is a bottom perspective view of a socket of the assembly of FIG. 8.

More specifically, as shown in FIGS. 12 and 13, this asymmetry is created by the polygonal end 56 including a first keying element or notch 68 and the polygonal opening 58 including a second keying element or mating key protrusion 70 constructed and arranged for engaging the first keying notch. Upon engagement with each other, the first keying notch 68 and the second mating key protrusion 70 provide a secure physical and electrical connection between the cord 52 and the socket 54. Similar to the assembly 10, the polygonal end 56 of assembly 50 includes the at least one contact prong opening 28, and the polygonal opening 58 includes the at least one contact prong 30 for engaging the at least one contact prong opening. It is contemplated that this arrangement provides a secure connection between the cord 52 and the socket 54. However, it is appreciated that other mating arrangements are possible, as are known in the art, and that, as is the case with the assembly 10, the prongs 30 and openings 28 may be exchanged or alternate on the cord 52 and socket 54.

The socket 54 further includes a pair of buttons 72 constructed and arranged for releasably receiving a hanging device such as a hook or loop (not shown). It is contemplated that the hanging device can be received by a wall hook or other retaining device for storing the appliance when not in use.

Figure 7:
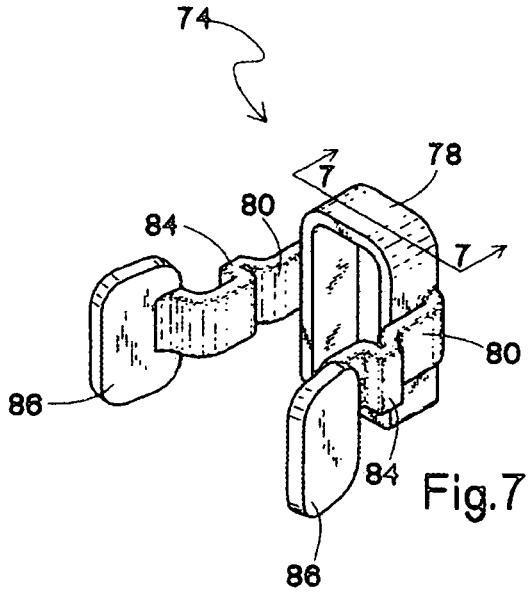
FIG. 7 is a top perspective view of a lock of the assembly of FIG. 1.
Figure 7A:
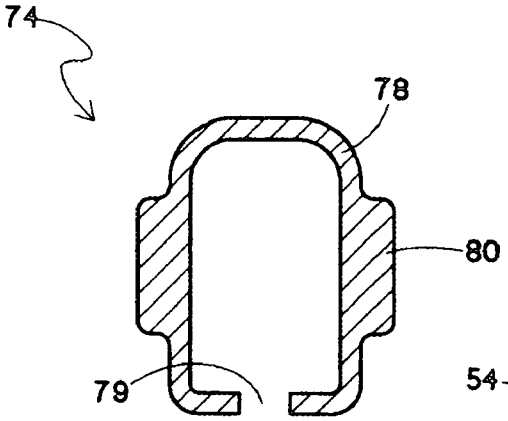
FIG. 7*a* is a cross-section taken along the line 7-7 of FIG. 7 and in the direction indicated.

Referring now to FIGS. 7 and 7*a*, the assemblies 10 and 50 each further include a lock 74, and the cords 12, 52 each further include a channel 76. As seen in FIGS. 5 and 12, the channel 76 is closer to the free ends 17, 57 of the polygonal ends 16, 56 than to the main cord portions 13, 53. For positively maintaining the electrical and physical connection between the cords 12, 52 and the sockets 14, 54, the lock 74 is removably received in the channel 76 and configured for detachably engaging a corresponding formation on the socket 14 or 54. Included on the lock 74 is a band 78 dimensioned to be received in the channel 76. Also included on the band 78 is a gap 79 configured for enabling the lock to be releasably attached to the channel 76. The lock 74 is preferably made from a lightweight plastic, enabling the user to easily spread the band 78 at the gap 79 to place the band around the cord 12 or 52 and into the channel 76. An advantage of the removable lock 74 is that it is easily replaced when broken without removing the polygonal end 16 from the cord 12.

Figure 8:
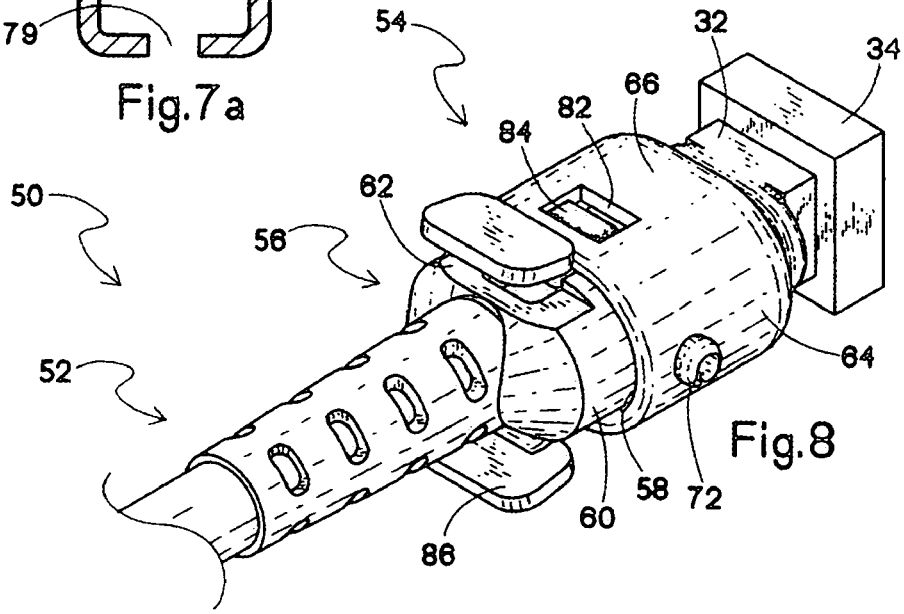
FIG. 8 is a top perspective view of an alternate embodiment of the present electrical cord assembly.
Figure 9:
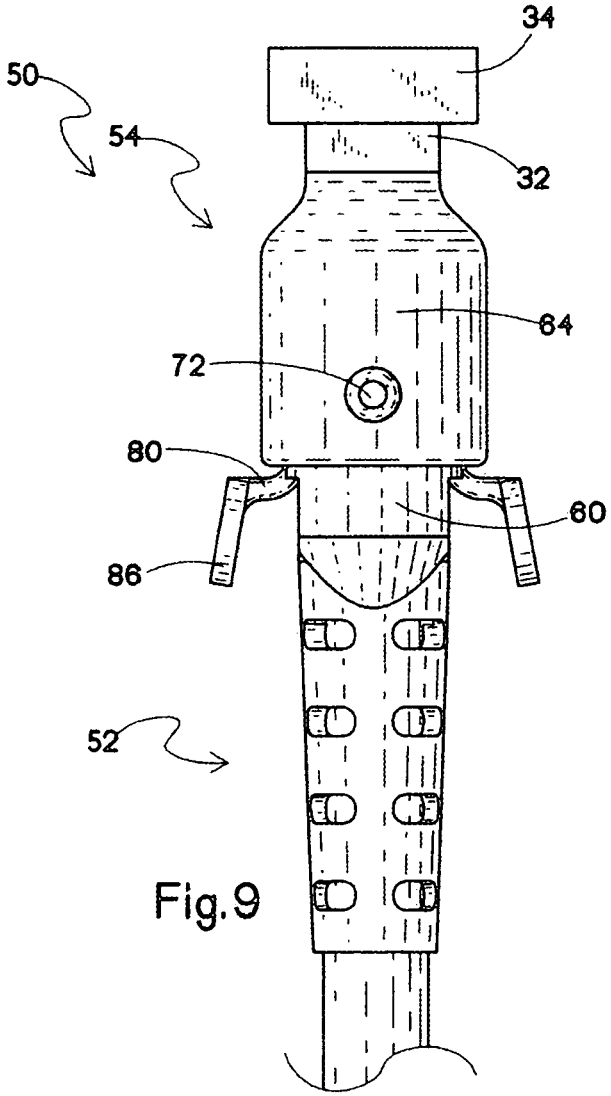
FIG. 9 is a top view of the assembly of FIG. 8.
Figure 10:
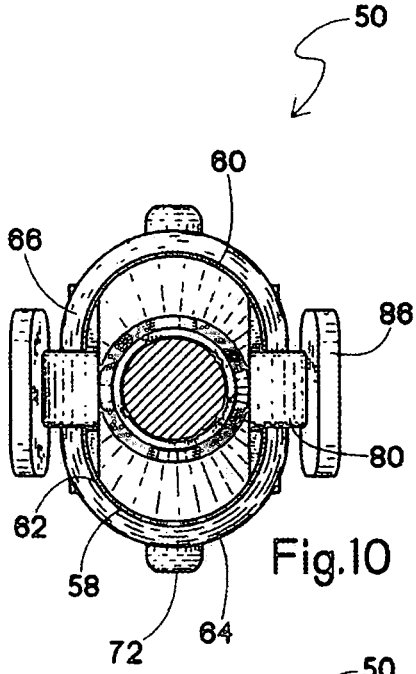
FIG. 10 is a front view of the assembly of FIG. 8.
Figure 11:
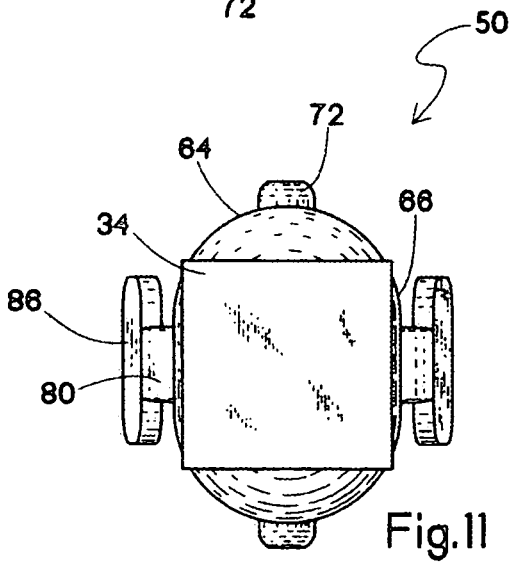
FIG. 11 is a rear view of the assembly of FIG. 8.

Referring to FIGS. 1, 7, and 8, the lock 74 further includes at least one and preferably a pair of arms 80 extending from the band 78 and arranged substantially parallel to the cord longitudinal axis. It is preferred that the arms 80 are biased outwardly due to an inherent biasing force from their cantilevered attachment to the band 78. The arms 80 are configured for being received by the tracks 48 and the grooves 46 when the lock is attached to the cord 12, and by the keyed notch 68 and the mating key protrusion 70 when the lock is attached to the cord 52. As seen in FIG. 6, each of the tracks 48 preferably includes a window 82. Similarly, as shown in FIG. 13, each of the first pair of socket sides 64 preferably includes the window 82. Each of the arms 80 also preferably includes a lug 84 constructed and arranged for engaging the windows 82 and releasably retaining the cord 12 or 52 to the socket 14 or 54, respectively. In addition, each of the arms 80 further includes a laterally outwardly projecting tab 86 configured for grasping by the user for overcoming the bias of the arms and releasing the cord 12 or 52 from the socket 14 or 54, respectively.

When the user wishes to remove the cord 12 or 52 from the socket 14 or 54, they simply press downward on the tabs 86, causing the lugs 84 to retract from the windows 82. When the user pulls on the cord 12 or 52 in a direction away from the socket 14 or 54, the polygonal end 16 or 56 slides along the tracks 48 or mating key protrusion 70, and out of the polygonal opening 22 or 58, respectively. Similarly, when replacing the cord 12 or 52 into the socket 14 or 54, the user simply aligns the first and second cord sides 18, 20 or 60, 62 with the first and second socket sides 24, 26, or 64, 66 and pushes the polygonal end 16 or 56 into the polygonal opening 22 or 58, respectively. The arms 80 will slide along the tracks 48 or mating key protrusion 70 until the lugs 84 are received in their corresponding windows 82, securing the cord 12 or 52 to the socket 14 or 54, respectively.

Another advantage of the present assembly is that it reduces cord clutter in a barber shop or hair salon environment, which will be described with respect to assembly 10, shown in FIGS. 1-7. However, the same reduction in clutter can be obtained from the assembly 50, shown in FIGS. 7-13. The user is provided with a plurality of appliances, each with a socket 14, 54 and a single cord 12, 52. The lock 74 is attached to the cord channel 76, and the polygonal end 16 is inserted into the polygonal opening 22. Then, the cord 12 is plugged into an electrical outlet (not shown) and the appliance is used as desired. After the user is finished with that particular appliance, the polygonal end 16 is removed from the polygonal opening 22, and the cord 12 is inserted into the polygonal opening 22 of another of the plurality of electric hair appliances. It can be seen that the present cord and socket assembly allows the user to operate several electrical appliances with only one cord, thereby reducing cord clutter.

While particular embodiments of the present electrical cord assembly have been described herein, it will be appreciated by those skilled in the art that changes and modifications may be made thereto without departing from the invention in its broader aspects and as set forth in the following claims.

The invention claimed is:

1. An electrical cord assembly comprising a cord and a socket; wherein the cord comprises a polygonal end having a free end face adjoined by at least one first pair of substantially parallel and substantially equal sides; and a second pair of substantially parallel and substantially equal sides such that only one of the two pairs of the polygonal end are equal when viewed at the end face; further along only one side of the polygonal end is a first keying element beginning at and perpendicular to the end face; wherein the first keying element is intersected by a channel which encompasses the perimeter of the polygonal end near the free end; and the socket comprises a complimentary polygonal opening which receives the polygonal end of the cord;

the socket having a side which defines a second keying element; wherein the first keying element with the intersecting channel of the polygonal end receives the second keying element of the socket such that only one orientation produces an electrical connection.

2. The assembly of claim 1 wherein said socket includes a pair of buttons radially extending therefrom, each of said buttons being constructed and arranged for releasably receiving a corresponding end of a hanging device.

3. The assembly of claim 1 further including a lock having a band, wherein said polygonal end defines a channel, said band being removably received in said channel such that upon attachment of said polygonal end to said socket, said socket encloses said band.

4. The assembly of claim 1 wherein said polygonal end includes at least one contact prong opening.

5. The assembly of claim 4 wherein said polygonal opening includes at least one contact prong configured for engaging said at least one contact prong opening.

6. The assembly of claim 1 wherein said socket further includes a neck portion adjacent said polygonal opening and a radially enlarged cuboidal end adjacent said neck portion, said cuboidal end configured for being secured within the electrical appliance.

7. The assembly of claim 6 wherein said polygonal end and said polygonal opening define a generally oval shaped portion.

8. The assembly of claim 7 wherein said polygonal end includes a keyed notch and said polygonal opening includes a mating key protrusion constructed and arranged for engaging said keyed notch.

9. The assembly of claim 1 wherein one member of said second pair of cord sides includes a pair of radiused cord corners, and the other member includes a pair of right angle cord corners, and wherein one member of said second pair of socket sides includes a pair of radiused socket corners and the other member includes a pair of right angle socket corners.

10. The assembly of claim 9 wherein said pair of radiused cord corners is displaced from said pair of right angle cord corners by said second pair of cord sides.

11. The assembly of claim 10 wherein said second pair of cord sides includes a pair of ears.

12. The assembly of claim 11, wherein said second pair of socket sides includes a pair of tracks, wherein upon engagement with said cord, said tracks are aligned with said ears.

13. The assembly of claim 9 wherein said pair of radiused socket corners is displaced from said pair of right angle socket corners by said second pair of socket sides.

14. The assembly of claim 13 wherein said polygonal end further includes a pair of grooves arranged substantially parallel to said cord longitudinal axis, said pair of grooves aligned with and longitudinally displaced from said ears.

15. An electrical cord assembly configured for use with an electrical appliance, comprising:

a cord having a main cord portion and a polygonal end defining a channel that is closer to a free end of said polygonal end than to said main cord portion;

a socket defining a polygonal opening constructed and arranged for receiving said polygonal end; and a lock detachably engaged on said polygonal end and configured for removably securing said cord in said socket, said lock having a band including a gap in a side thereof configured for enabling removal of said band from said channel without removing said polygonal end from said cord.

16. The electrical cord assembly of claim 15 wherein said polygonal end further includes a channel and a pair of grooves, said grooves arranged substantially parallel to a longitudinal axis of said cord, and wherein said polygonal opening further includes tracks, each said track including a window, wherein upon engagement with said cord, said tracks are arranged in alignment with said grooves.

17. The electrical cord assembly of claim 15 wherein said lock includes a pair of arms extending from said band and arranged substantially parallel to said cord longitudinal axis, said pair of arms configured for being received within said polygonal opening upon attachment of said cord to said socket.

18. The electrical cord assembly of claim 17 wherein each of said arms includes a lug configured for engaging a corresponding window defined by said polygonal opening, and a tab provided distally from said band and configured for releasably retaining said cord to said socket.

19. A method for reducing cord clutter in a hair salon environment, the method provides:

an electrical cord assembly including a cord and complimentary sockets, wherein the cord has a polygonal end within which is a channel for releasably receiving a lock that serves to secure said cord within the complimentary socket; each of the sockets associated with a corresponding hair appliance, wherein each socket defines a polygonal shaped opening for mating engagement with said polygonal end of the cord, the socket further comprising a neck portion and a radially enlarged cuboidal end which serves to secure the socket within the corresponding appliance, thus a single cord can be used to electrically connect with a plurality of electric hair appliances by:

inserting the polygonal end of the cord into the polygonal socket opening of one appliance;

disengaging the lock and removing the polygonal end of the cord from the polygonal socket opening; and inserting the cord into the polygonal socket opening of another of the plurality of electric hair appliances.

20. The method according to claim 19 wherein the lock has a band including a gap; and further including removing the lock from the cord by pulling the band apart such that the gap increases.

* * * * *